US010513372B2

(12) United States Patent
Wang

(10) Patent No.: US 10,513,372 B2
(45) Date of Patent: Dec. 24, 2019

(54) CHILD RESISTANT BAG

(71) Applicant: ASUWANT PLASTIC PACKAGING CO., LIMITED, Hui Zhou, Guangdong (CN)

(72) Inventor: Peng Wang, Guangdong (CN)

(73) Assignee: ASUWANT PLASTIC PACKAGING CO., LIMITED, Hui Zhou, Guangdong (CN)

( * ) Notice: Subject to any disclaimer, the term of this patent is extended or adjusted under 35 U.S.C. 154(b) by 0 days.

(21) Appl. No.: 16/115,518

(22) Filed: Aug. 28, 2018

(65) Prior Publication Data

US 2018/0362220 A1 Dec. 20, 2018

(30) Foreign Application Priority Data

Jul. 17, 2018 (CN) ..... 2018 1 0783297

(51) Int. Cl.
*B65D 33/00* (2006.01)
*B65D 33/25* (2006.01)
*B65B 61/18* (2006.01)

(52) U.S. Cl.
CPC ..... *B65D 33/2508* (2013.01); *B65B 61/188* (2013.01); *B65D 2215/00* (2013.01)

(58) Field of Classification Search
CPC ..... B65D 33/2508; B65D 2215/00; B65B 61/188
USPC ..... 383/63
See application file for complete search history.

(56) References Cited

U.S. PATENT DOCUMENTS 6,151,868 A * 11/2000 Matthews ..... B65B 9/213 53/133.4
6,939,040 B2 * 9/2005 Schneider ..... B65D 33/2591 383/204
7,674,039 B2 * 3/2010 McMahon ..... B65D 33/20 383/103
8,061,898 B2 * 11/2011 Pawloski ..... B65D 33/01 24/399
2002/0020481 A1 * 2/2002 Bodolay ..... B65D 33/2533 156/66
2002/0094138 A1 * 7/2002 Schneider ..... B65D 33/2591 383/5
2007/0183692 A1 * 8/2007 Pawloski ..... B65D 33/2508 383/61.2
2008/0089620 A1 * 4/2008 Schneider ..... B65D 33/2591 383/64
2008/0232722 A1 * 9/2008 Pawloski ..... B65D 33/01 383/64
2011/0033138 A1 * 2/2011 Cameron ..... B65D 33/2525 383/210

(Continued)

*Primary Examiner* — Peter N Helvey

(57) ABSTRACT

A child resistant bag includes: a front piece, a rear piece, a first zipper tape, a second zipper tape and a protective sheet; wherein both sides and a lower side of the first piece are respectively connected with the second piece; an up side of the first piece and an up side of the rear piece are both opened; the first zipper tape is provided on an internal face on the up side of the front piece; wherein an entire surface of a single face of the first zipper tape is integrally adhered and connected with the front piece; the second zipper tape is provided on an internal face on the up side of the rear piece; wherein the second zipper tape is adhered and connected into one body with the rear piece only by a low side portion.

18 Claims, 9 Drawing Sheets

(56) References Cited

U.S. PATENT DOCUMENTS

| | | | | |
|---|---|---|---|---|
| 2012/0045151 | A1* | 2/2012 | Eouzan | B65D 33/2541 383/42 |
| 2014/0161374 | A1* | 6/2014 | Septien Rojas | B65D 33/2508 383/63 |
| 2014/0270585 | A1* | 9/2014 | Heckman | B65D 33/2508 383/63 |
| 2016/0122087 | A1* | 5/2016 | Takigawa | B65D 33/2508 383/63 |

* cited by examiner

CHILD RESISTANT BAG

CROSS REFERENCE OF RELATED APPLICATION

The present application claims priority under 35 U.S.C. 119(a-d) to CN 201810783297.1, filed Jul. 17, 2018.

BACKGROUND OF THE PRESENT INVENTION

Field of Invention

The present invention relates to the technical field of a zippered bag, and more particularly to a child resistant bag.

Description of Related Arts

Plastic zipper bag is a common package for storing goods in daily life. Plastic zipper bag has the characteristics of moisture-proof, oxygen-proof, fresh-keeping, easy-sealing etc., and can be utilized for loading documents and medicines, etc.. Since the zipper bag has a zipper tape on an opening portion, wherein the zipper tap can be opened and closed at will, making it easy to use. However, the ordinary zipper bag can be easily opened or pulled by child. If the bag contains drugs or other goods that can cause harm to child, it is easy for child to eat, which may cause danger or injury.

There are already some child resistant bags in the conventional arts, for example:

A patent document with the application number of 201720125302.0 discloses a child resistant bag, comprising a bag body and a first zipper, wherein the bag body comprises a front piece and a back piece. The first zipper comprises a first zipper tape and a second zipper tape, wherein the first zipper tape is provided on a top end of the front piece; the second zipper tape is provided on a top end of the rear piece. The first zipper tape comprises two male rails; the second zipper tape comprises two female rails; wherein cross sections of the male rails and the female rails are all in a shape of a circular arc. The male rails are capable of engaging with or separating from the female rails, which makes that the first zipper tape is capable of engaging or separating from the second zipper tape; in such a manner that the bag body is sealed or opened. A front twisting and pressing portion and a rear twisting and pressing portion are respectively provided on external surfaces of the front piece and the rear piece; wherein the front twisting and pressing portion and the rear twisting and pressing portion are respectively provided close to the first zipper tape and the second zipper tape. For the zipper bag, the first zipper is opened by twisting and pressing the front twisting and pressing portion and the second twisting and pressing portion. However, it is difficult for ordinary child to find the effects of the front twisting and pressing portion and the second twisting and pressing portion, thereby preventing the zipper bag from being accidentally opened by child.

Although the zipper bag can prevent the child from opening to a certain extent, since cross sections of the male rail and the female rail are all in circular arc shapes, and if the child generally wants to open the packaging bag, it is customary to use both hands to pull double sides of the bag body outward respectively. Pulling outwards can just make male rails separate from the arc entrance of the female rail. If the child is strong, it is easier to open the bag, and there is still the danger of being accidentally opened by child.

SUMMARY OF THE PRESENT INVENTION

An object of the present invention is to provide a child resistant bag, which is aimed at solve the problems that the conventional sealed zipper bag is easily torn by child.

Accordingly, in order to achieve the objects mentioned above, the present invention provides a child resistant bag:

a front piece;

a rear piece; wherein a first side of the front piece, a second side of the front piece and a low side of the front piece are respective adhered with a first side of the rear piece, a second side of the rear piece and a low side of the second piece; wherein an up side of the first piece and an up side of the rear piece are both opened;

a first zipper tape provided on an internal face on the up side of the front piece; wherein an entire surface of a single face of the first zipper tape is integrally adhered and connected with the front piece;

a second zipper tape provided on an internal face on the up side of the rear piece; wherein the second zipper tape is adhered and connected into one body with the rear piece only by a low side portion; at least one pair of snap fasteners which is in a shape of a strip is formed between a bottom end of an up side portion of the second zipper tape and an internal side of the first zipper tape;

a protective sheet, which is in a shape of a strip and provided in parallel with the first zipper tape; wherein an upper side of the protective sheet is adhered to the internal face on the up side of the front piece; a lower side of the protective sheet form a gap with the front piece; the up side portion of the second zipper bag is tightly inserted into the gap.

Preferably, both sides of the protective sheet is adhered on the front piece.

Preferably, the pair of snap fasteners comprise a female buckle and a male buckle; wherein the male buckle comprises a neck portion extending from the first zipper tape of the second zipper tape, an umbrella-shaped head extending from a top end of the neck portion; the female buckle comprises a groove portion which has a U-shaped cross section for receiving the umbrella-shaped head; and an elastic hook formed on an edge of the groove portion and extending inwardly towards the groove portion; wherein the umbrella-shaped head is inserted into the groove portion by pressing and bending the elastic hook to be deformed inwardly.

Preferably, an amount of the pairs of the snap fasteners is two; wherein a first male snap fastener in a first pair of the snap fasteners are formed on the first zipper tape; and a second male snap fastener of the pairs of the snap fasteners is formed on the second zipper tape.

Preferably, a first male buckle and a second male buckle of the two pairs of the snap fasteners are both provided on the first zipper tape or both on the second zipper tape.

Preferably, the first zipper tape is integrally connected into one body with the front piece by heat pressing; and the second zipper tape is integrally connected into one body with the rear piece by heat pressing.

Preferably, the protective sheet is adhered to the front piece by gluing.

Preferably, the front piece and the rear piece are made of a composite or non-composite plastic material comprising: PET plastic, OPP plastic, VMPET plastic, aluminum foil material, PE plastic and CPP plastic, wherein the first zipper tape and the second zipper tape are made of PE plastic or PP plastic.

Preferably, the protective sheet is made of PE plastic, PP plastic, PVC plastic or PET plastic.

Preferably, an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

Compared with the prior art, the technical solution of the present invention has the beneficial effects:

The present invention provides a child resistant bag, which is provided with a protective sheet above the first zipper tape of the front piece, and an upper portion of the second zipper tape opposite to the first zipper tape is provided with a movable zipper blade. By inserting the zipper blade into the protective sheet, the first snap fastener and the second snap fastener of the zipper are reversed toward a side where the front piece is located when the child pulls the front piece and the rear piece outward. The force point of the pulling is below the first snap button and the second snap button, and the zipper is not pulled apart, which can effectively prevent from being accidentally opened by the child. The present invention has a simple structure and solves the security problems in the conventional ordinary bag of easily being opened by the child.

Secondly, the pair of snap fasteners in the zipper for preventing the child from opening in the present invention adopts a fitting structure comprising a female buckle and a male buckle, which have a good fitting strength when the zipper is closed, so that under the action of the protective sheet, tt is more difficult for the child to open the zipper. After the zipper blade is pulled out from the protective sheet, the two pairs of snap fasteners can be sequentially released in the order from top to bottom, and the opening and closing by the adult is also convenient.

BRIEF DESCRIPTION OF THE DRAWINGS

In order to more clearly illustrate the technical solutions in the preferred embodiments of the present invention or the conventional arts.

Figure 1:
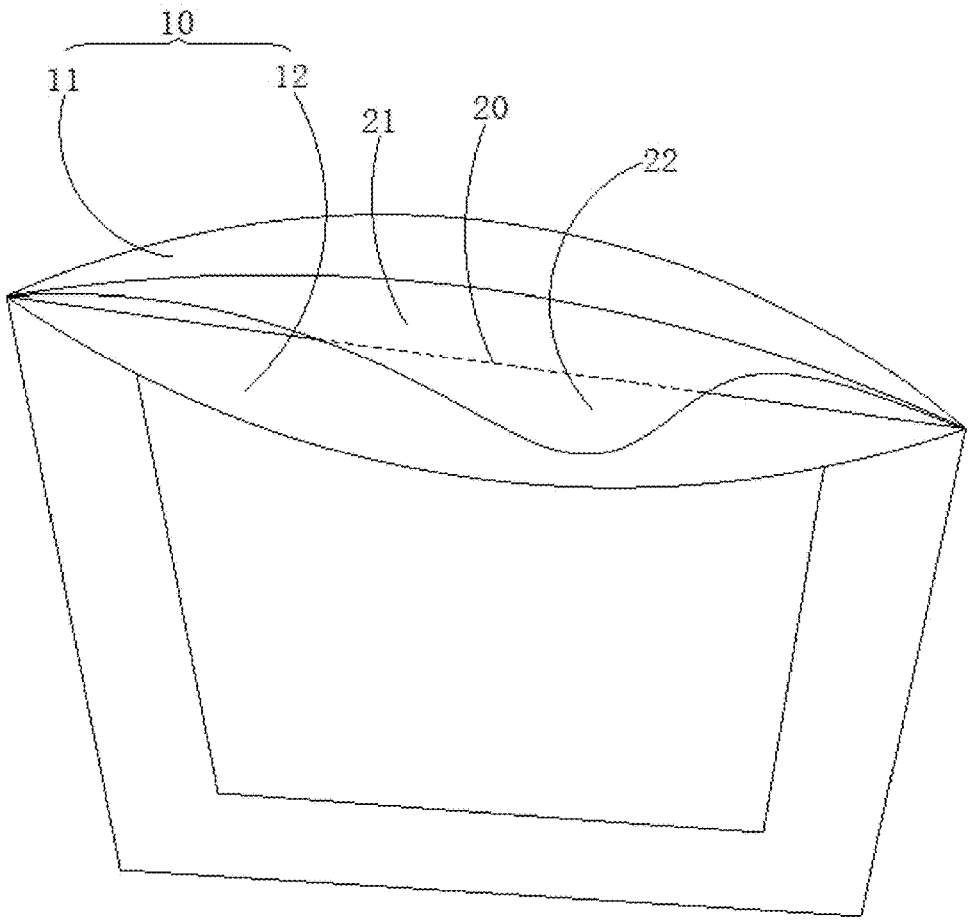
FIG. 1 is a structural schematic view of a child resistant bag according to a first preferred embodiment of the present invention.

References of numbers in the Figs of the present invention:

| Reference number | Name |
|---|---|
| 10 | bag body |
| 11 | front piece |
| 12 | rear piece |
| 13 | protective sheet |
| 14 | gap |
| 15 | entrance |
| 20 | zipper |
| 21 | first zipper tape |
| 211 | first substrate |
| 212 | first snap fastener |
| 212a | groove portion |
| 212b | elastic hook |
| 22 | second zipper tape |
| 221 | second substrate |
| 221a | upper side portion |
| 221b | lower side portion |
| 222 | second snap fastener |
| 222a | neck portion |
| 222b | umbrella-type head |
| O | boundary |

DETAILED DESCRIPTION OF THE PREFERRED EMBODIMENT

Further description of the technical solutions in the preferred embodiments of present invention is illustrated more apparently and completely combining with the accompanying drawings of the preferred embodiments. It is apparent that the described embodiments are only a part of the preferred embodiments of the present invention, and not all of the embodiments. All other embodiments obtained by those skilled in the art based on the embodiments of the present invention without creative efforts are within the scope of the present invention.

It should be noted that all directional indications, such as up, down, left, right, front, back, in the preferred embodiments of the present invention are only used to explain relative positional relationships between components in a certain posture and motion situation as shown in the drawing. If the specific posture changes, the directional indication also changes accordingly.

In addition, the descriptions of "first", "second", and the like in the present invention are intended for the purpose of description only, and are not to be construed as indicating or implying their relative importance or implicitly indicating the number of technical features indicated. Thus, defining "first" or "second" features may comprise at least one of the features, either explicitly or implicitly. In the description of the present invention, the meaning of "a plurality" is at least two, such as two, three, etc., unless specifically defined otherwise.

In the present invention, the terms "connected", "fixed" and the like should be understood broadly, unless otherwise clearly defined and defined. For example, "fixed" may be a fixed connection or a detachable connection, or may be integrated; it may be a mechanical connection or an electrical connection; it may be directly connected or indirectly connected through an intermediate medium, and may be an internal connection of two elements or an interaction relationship of two elements unless explicitly defined otherwise. The specific meanings of the above terms in the present invention can be understood by those skilled in the art on a case-by-case basis.

In addition, the technical solutions between various preferred embodiments of the present invention may be combined with each other, but must be based on a fact that those skilled in the art are capable of achieving, and the combination of technical solutions are considered not exist, when the combination of technical solutions is contradictory or impossible to implement. It does not exist and is not within the scope of protection required by the present invention.

The present invention provides a child resistant bag.

Referring to FIGS. 1-11, a child resistant bag comprises: a bag body 10 and a zipper 20. In the description below, the upper-lower directions or the front-rear directions are all based on the direction of the FIG. 1. The direction where the entrance is located is an up side. The direction where the front piece located is a front side.

Figure 2:
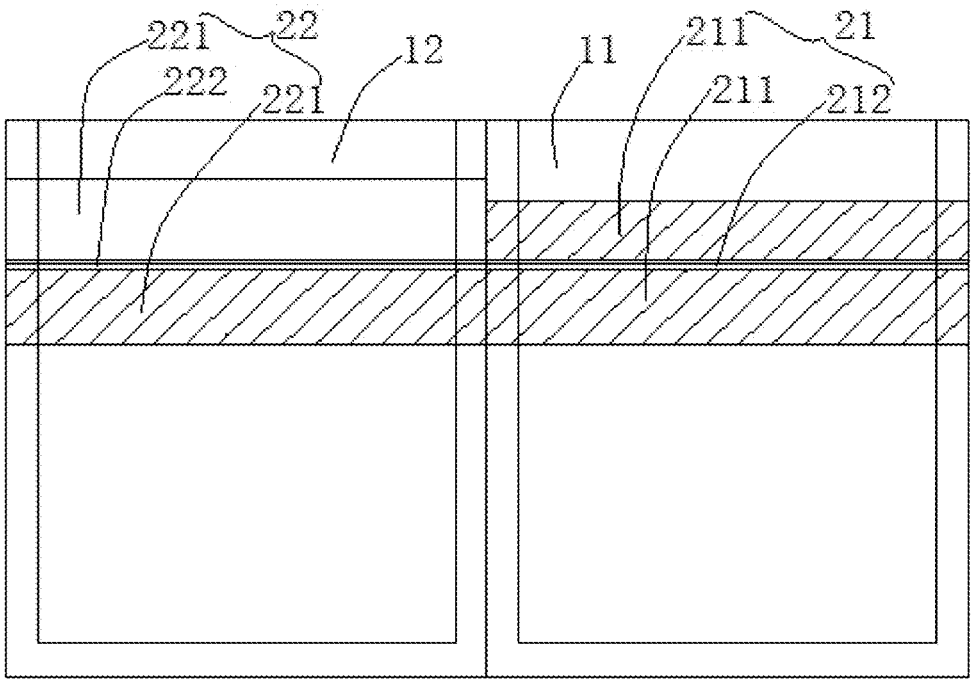
FIG. 2 is an internal unfolding view of the child resistant bag of the FIG. 1.

Referring to FIG. 1 to FIG. 2, the bag body 10 comprises: a front piece 11 and a rear piece 12; wherein a left side of the front piece 11, a right side of the front piece 11 and a low side of the front piece 11 are respectively adhered to a left side of the rear piece 12, a right side of the rear piece 12 and a low side of the rear piece 12, so as to form a receiving space for receiving files and drugs. An entrance 15 which is open is provided on an up side of the bag body 10, wherein objects are put into the bag body through the entrance 15. Other portions of the receiving space are all sealed except the entrance 15. The bag body 10 can be made of a film material such as vinyl resin or other composite or non-composite plastic materials, including PET plastic of polyethylene terephthalate plastic; OPP plastic of polypropylene plastic; VMPET plastic of polyester aluminized film or aluminum foil material; PE plastic of polyethylene resin plastic or CPP plastic of un-stretched polypropylene film plastic or cast polypropylene film plastic. In addition, it can be understood that the bag body 10 can also be structure with other shapes comprising a bottom surface, as long as the zipper can be provided on an opening of the bag body, which should be all within the protection scope of the present invention, and is not limited herein.

The zipper 20 comprises a first zipper tape 21 and a second zipper tape 22. The first zipper tape 21 comprises a first substrate 211 which is in a shape of a strip and a first snap fastener 212 provided along a length direction of the first substrate 211. The second zipper tape 22 comprises a second substrate 221 which is in a shape of a strip and a second snap fattener 222 provided along a length direction of the second substrate 221; wherein the first substrate 211 and the second substrate 221 are provided on an internal side of the entrance of the bag body 10; the first snap fastener 212 and the second snap fastener 222 are capable of engaging and connecting with each other. In the conventional preferred embodiments, the entrance can be easily opened and closed by applying a relative force to the front piece 11 and the rear piece 12 on the entrance.

Figure 4:
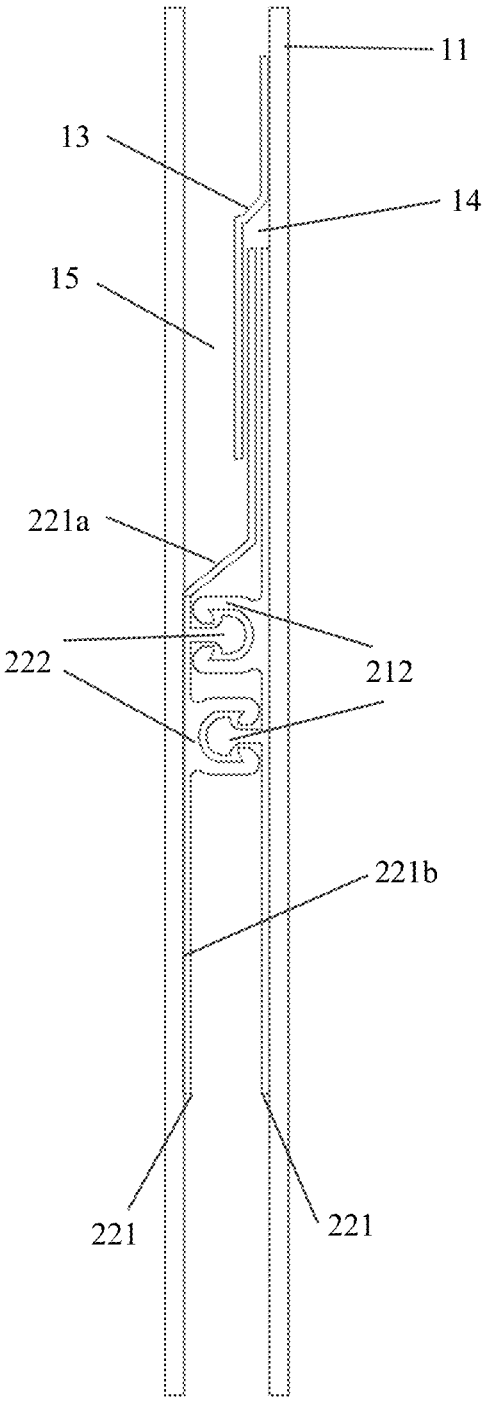
FIG. 4 is a cross-sectional view of the child resistant bag after combining with a zipper.
Figure 5:
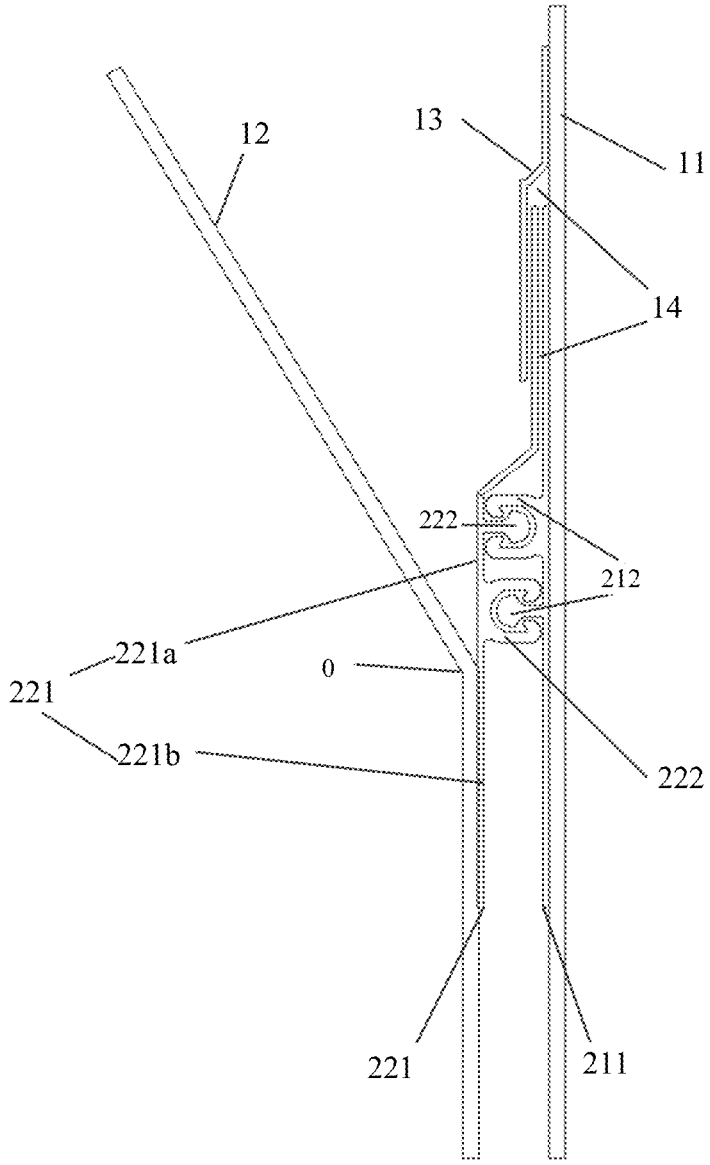
FIG. 5 is a detailed cross-sectional view of a rear piece and the child resistant bag of the FIG. 1.
Figure 6:
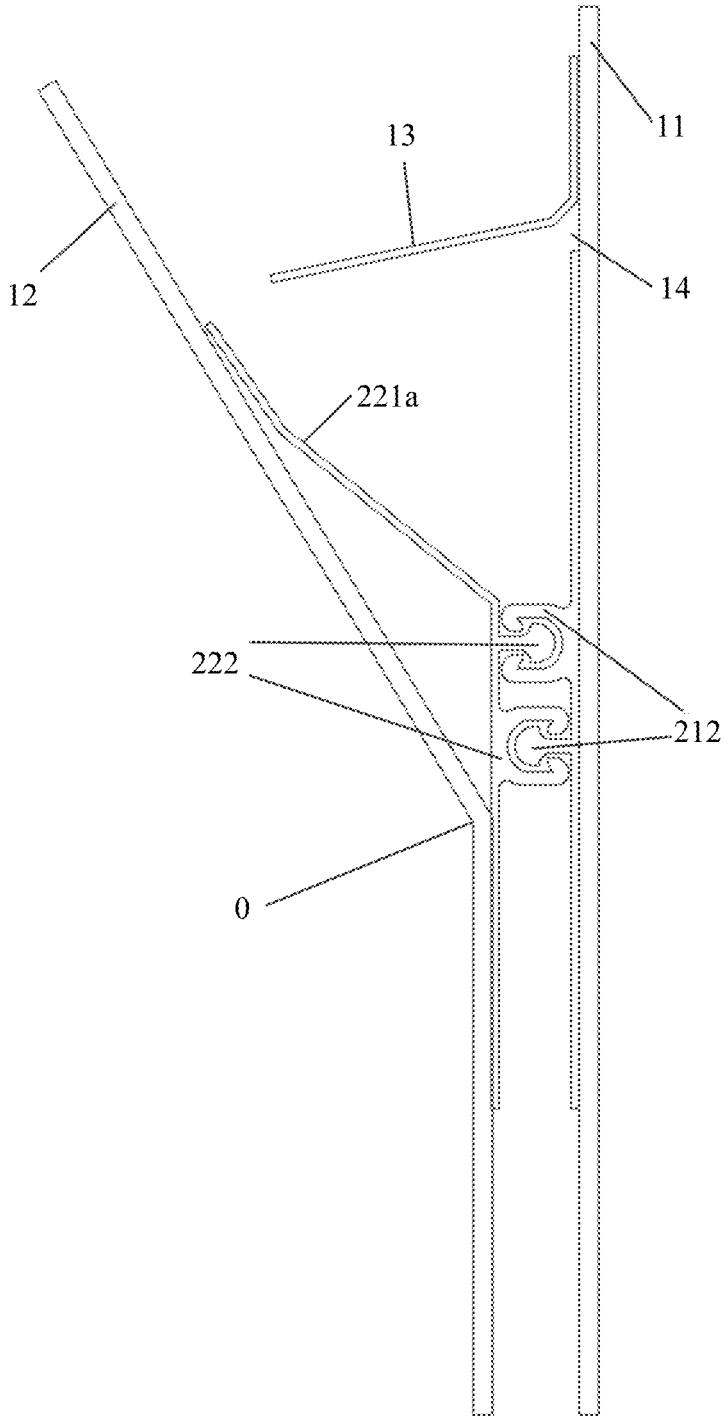
FIG. 6 is a cross-sectional view showing an upper portion of the second zipper tap extending from a protective sheet of the second zipper tap while opening an entrance of the child resistant bag of the FIG. 1.
Figure 7:
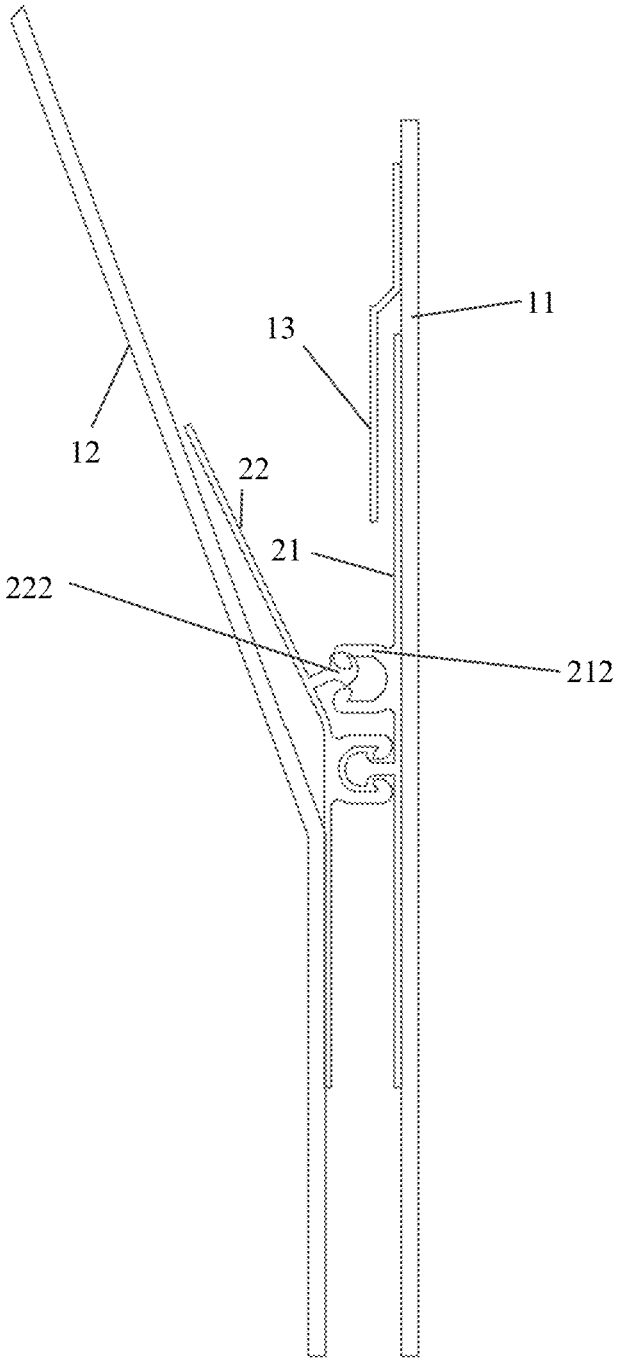
FIG. 7 is a cross-sectional view of the child resistant bag of the FIG. 1 showing the first snap-fastener and the second snap-fastener are completely separated in the beginning.
Figure 8:
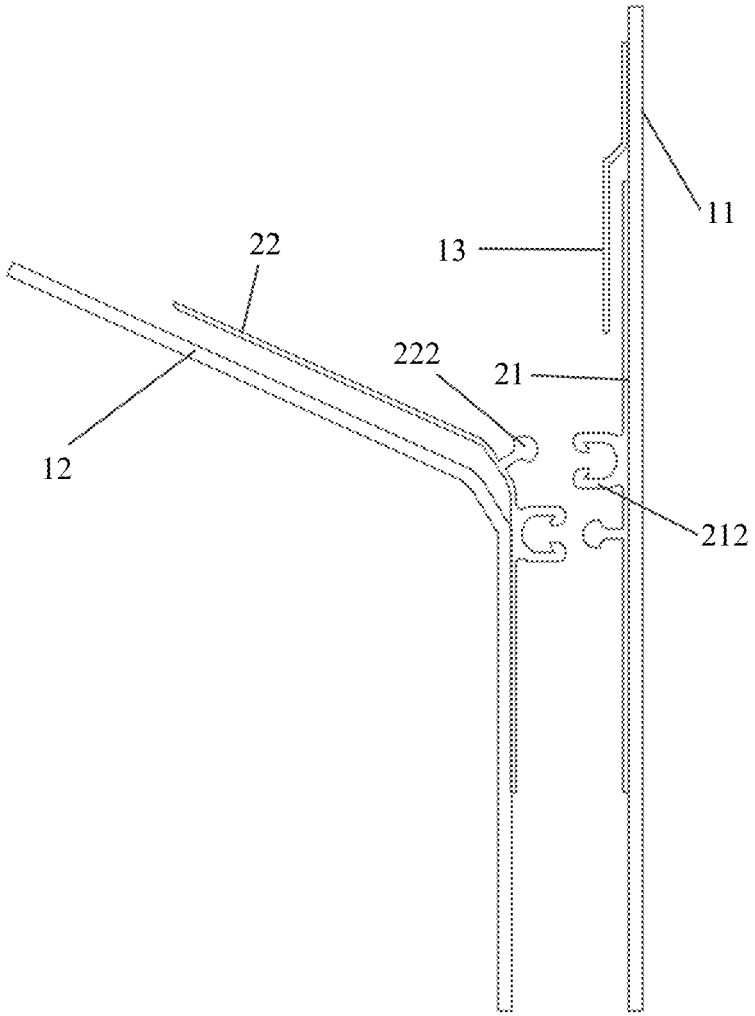
FIG. 8 is a cross-sectional view of the child resistant bag of the FIG. 1 showing the first snap-fastener and the second snap-fastener are completely separated.
Figure 9:
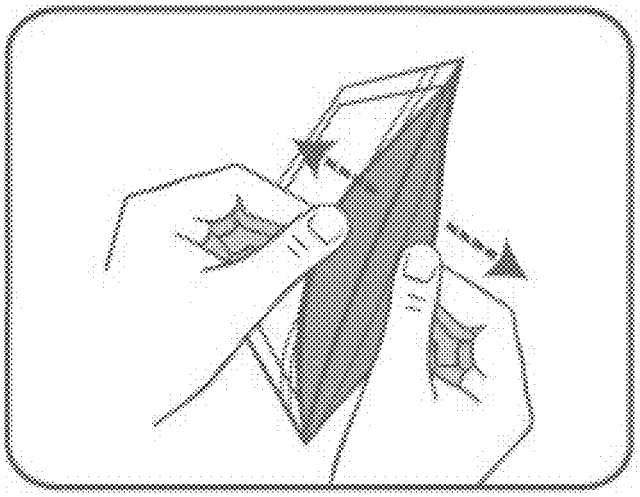
FIG. 9 is a schematic view of a step (1) of the child resistant bag of the FIG. 1.
Figure 10:
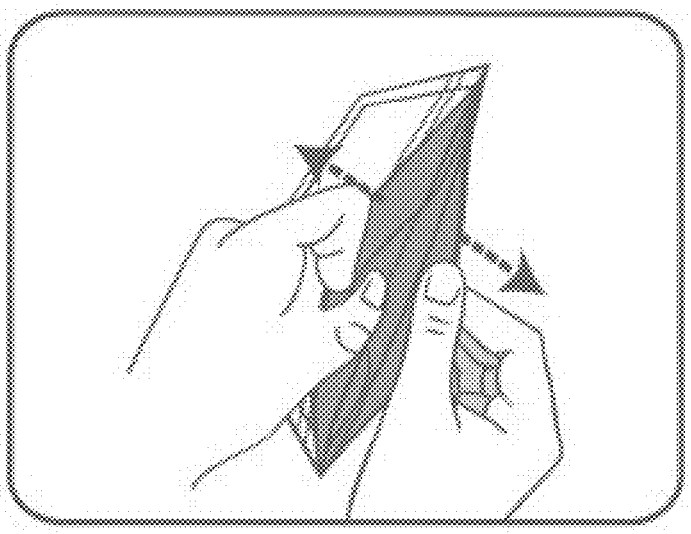
FIG. 10 is a schematic view of a step (2) of the zipper bag child resistant bag of the FIG. 1.
Figure 11:
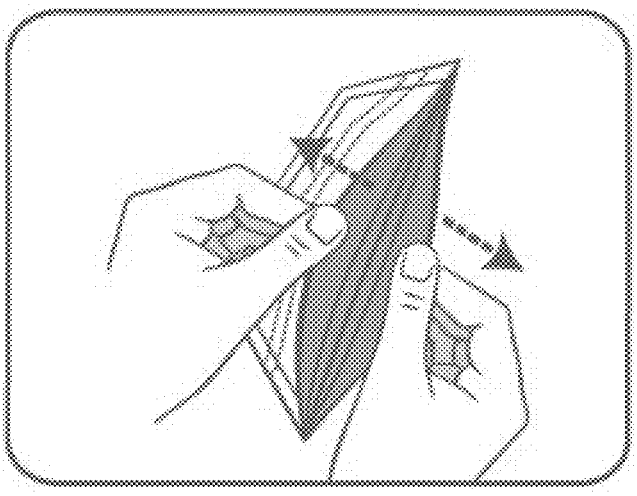
FIG. 11 is a schematic view of a step (3) of the child resistant bag of the FIG. 1.

Referring to FIGS. 4-5, in the preferred embodiment of the present invention, a protective sheet 13 which is in a shape of a strip is provided on a front piece 11 on the entrance; wherein a length of the protective sheet 13 along an extending direction is basically identical to a left-right width of the front piece 11. An up side of the protective sheet 13 is connected with an up portion of the front piece 11; the protective 13 is adhered on the front piece 11, in such a manner that a gap 14 is formed between a low side of the protective sheet 13 and the front piece 11. In addition, an entire front surface of the first substrate 211 is integrally connected with an internal side of the front piece 11. The second substrate 221 comprises an upper side portion 221*a* and a lower side portion 221*b*; wherein the second substrate 221 is only integrally connected with an internal side of the rear piece 12 through the lower side portion 221*b*. The upper side portion 221*a* and the lower side portion 221*b* has a boundary line o therebetween. The second snap fastener 222 is provided above the boundary line o and on the upper side portion 221*a*; wherein the upper side portion 221*a* is equivalent to a free shifted zipper blade.

When the first snap fastener 212 is fastened with the second snap fastener 222, the zipper is fastened; the upper side portion 221*a* of the blade of the zipper is inserted in the gap 14. When a child pulls an entrance portion of the bag body apart along front and rear directions with both hands, since an up end of the upper side portion 221*a* is inserted and fitted in the gap 14; wherein a force point at which the front piece 11 and the rear piece 12 are separated is located at the boundary line O of the upper side portion 221*a* and the lower side portion 221*b* of the second zipper tape as shown in FIG. 5, i.e., blow the second snap fastener 222; in such a manner that the first snap fastener 212 and the second snap fastener 222 are still closely connected to each other. The lower side portion 221*b* of the second zipper tape 22 is integrally connected with the real piece 12; so that the front piece 11 and the rear piece 12 are not capable f being separated from each other, so that the bag body is prevented from being accidentally opened by a child. The structure is simple, and the problems that the conventional ordinary packaging bag are easily opened by the child by mistake are solved.

Preferably, both sides of the protective sheet 13 are connected with the front piece 11, and an entire surface of the protective sheet 13 is closely adhered on the front piece 11; in such a manner that the gap formed between the lower side of the protective sheet 13 and the front piece 11 is closer, so as to facilitate fixing the second zipper bag 21 which is inserted therein.

Further, when the child pinches the front piece 11 with a thumb and forefinger, the upper side portion 221*a* of the second zipper tape 22 is also more firmly clamped in the gap 14 while being pulled outward with force, so that the bag body 10 is more difficult to be opened.

Referring to FIGS. 6-8 and FIGS. 9-11, a method for opening a bag body 10, comprises steps of:

step (1): pulling a front piece 11 and a rear piece 12 apart on an entrance 15;

step (2): pulling out a protective sheet 13 with a thumb, pulling an upper side portion 221*a* of a second zipper tape, i.e., a blade of a zipper, from a gap of the front piece 11 out, so that the upper side portion 221*a* is reversed towards the rear piece 12;

step (3): pinching the front piece 11 by a first hand, wherein a first zipper tape 21 and the protective sheet 13 are pinched at the same time; pinching the rear piece 12 and a second zipper tape 22 by a second hand; pulling out to both sides by the first hand and the second hand with force; in such a manner that a first snap fastener 212 and a second snap fastener begin to separate from an up end until completely separated, in such a manner that a zipper bag is opened.

Further, in order to make the fitting connection between the first snap fastener 212 and the second snap fastener 222 more difficult to be released, a pair of snap fasteners formed by the first snap 212 and the second snap 222 adopt a shape structure as follows.

Figure 3A:
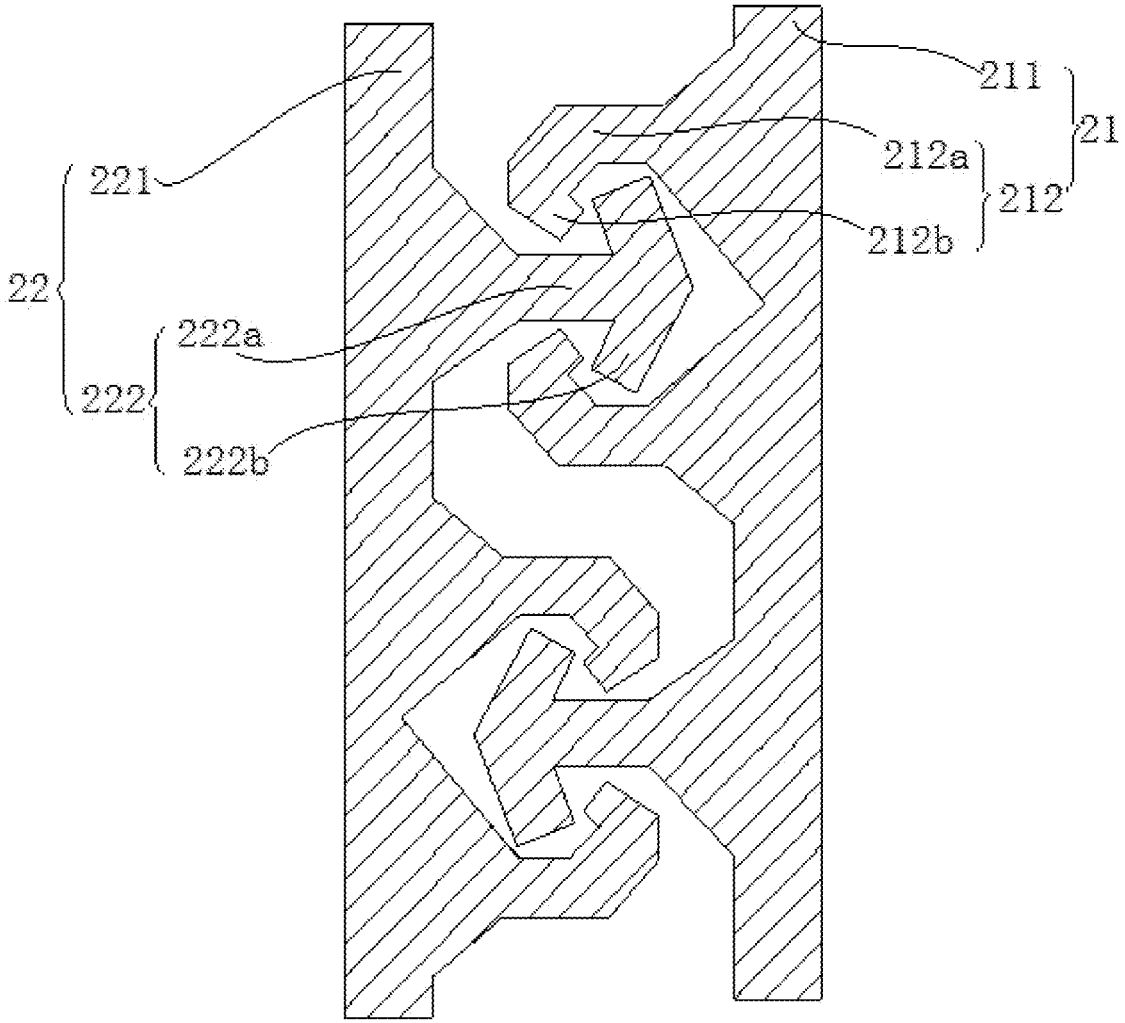
FIG. 3*a* is a first sectional view of a pair of snap-fasteners of the child resistant bag of the FIG. 1.
Figure 3B:
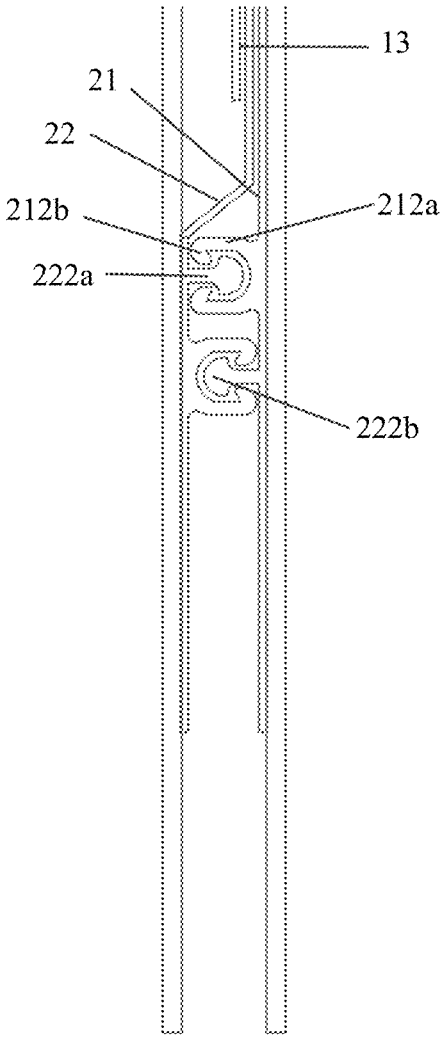
FIG. 3*b* is a second sectional view of a pair of snap-fasteners of the child resistant bag of the FIG. 1.

Referring to FIG. 3*a* and FIG. 3*b* again, the first snap fastener 212 is a female buckle, the second snap fastener 222 is a male buckle, and the male buckle comprises a neck portion 222*a* extending from the second zipper tape 22, an umbrella head 222*b* extending from a top end of from the neck portion 222*a*. The female buckle comprises a groove portion 212*a* with a U-shaped cross section formed on the first zipper tape 21 and for receiving an umbrella head 222*b*, a resilient hook 212*b* formed on an edge of the groove portion 212*a* and extending towards the groove portion 212*a*. The umbrella head 222*b* is inserted into the groove portion 212*a* by pushing and bending the elastic hook 212*b* inwardly, and when a force is applied to the male buckle in a direction opposite to an insertion direction, the elastic hook 212*b* is capable of preventing the umbrella head 222*b* from being detached from the groove portion 212*a*. Fitting structure in the preferred embodiment has better fitting strength than the conventional snap structures.

Preferably, snap fastener pair unit formed by the first snap fastener 212 and the second snap fastener 222 comprise two pairs of the first snap fastener 212 and the second snap fastener 222 arranged side by side, two pairs of snap fasteners being used together, making the front piece 11 and the rear piece 12 more difficult to open.

In some bag bodies with a zipper tape, if the zipper adopts a snap fastener structure with a high fitting strength, it is necessary to facilitate the hand by opening an easy tear opening on the bag body near the snap fastener or by using a tool to open a hole to pull the snap open, which will not only affect the sealing effect of the bag body and the shelf life of the bag body, but the appearance is not good. If the child pulls the easy-to-tear port, it is also possible to open the bag body, which is still not very safe to the child.

In the present embodiment, firstly, the zipper adopts a fitting structure in which the male buckle and the female buckle are matched. Compared with the conventional zipper, it is more difficult to be opened by the child with force. In the case where the child does not find the zipper blade hidden in the protective sheet 13, the bag body will not be opened no matter how to forcefully tear the bag body, and the safety effect is good. Secondly, the zipper blade, i.e., upper side portion 221*a*, is placed at the entrance 15 above the zipper. When the adult pulls the zipper blade out beforehand, then the zipper blade is pulled again to be separated from the first zipper tape 21, and the bag body can be smoothly opened. Compared with the need to separately sew the slit, based on a fact that bag body is intact, the opening method is easier in the present invention as long as the correct opening method is known, The opening method is easier.

Further, in the two pairs of the buttons in the preferred embodiments, the first zipper tape 21 is respectively provided with a first female buckle and a first male buckle, and the second zipper tape 22 is also respectively provided with a corresponding second male buckle and second female buckle. The buckle is arranged such that the female buckle and the male buckle on each zipper tape are staggered to better improve a fitting strength, making the first zipper tape 21 and the second zipper tape 22 also relatively uniform in structure, which is convenient for mass production.

However, it can be understood that, in each pair of the snap fasteners, the female buckle and the male buckle are respectively provided on a front side or a rear side of the bag body and providing ways are not limited to the manner in the preferred embodiment. All the corresponding male buckles may be provided on the bag body on a first side, all corresponding female buckles are provided on a second side of the bag body. In addition, the pair of snap fasteners formed by the male and female snaps comprises two pairs in this embodiment, and it is also understood that in other embodiments, with the regulation of a size of the bag body, an amount of pairs of snap fasteners can also be other quantities such as three or four.

Further, the first substrate 211 of the first zipper tape 21 and the front piece 11 are integrally adhered together by heat pressing; and the second substrate 221 of the second zipper tape 22 and the rear piece 12 are integrally adhered together by heat pressing. In the embodiment, therefore, in the embodiment, the first zipper tape and the second zipper tape can be made of PET plastic (polyethylene terephthalate plastic), PE plastic (polyethylene resin plastic) or PP plastic (polypropylene resin plastic). Materials are not limited. The first zipper tape and the second zipper tape can be made by materials as long as with excellent elasticity and capable of being melted by heating and then pressure-bonded to other materials of to the bag body.

Of course, the connection manner of the first zipper tape and the second zipper tape is not limited to the hot pressing method, and may be an adhesive method, or the first zipper tape is directly integrally formed with the front piece, and the second zipper tape and the rear slab are integrally formed.

Further, the protective sheet 13 is made of PE plastic (polyethylene resin plastic) or PP plastic (polypropylene resin plastic) or PVC plastic (polyvinyl chloride plastic) or PET plastic (polybutylene plastic). The protective sheet 13 is adhered to the front piece 11 by gluing, so that the upper end portion of the protective sheet 13 is glued close to the upper edge of the first zipper tape 21 during processing, and an upper side portion of the first zipper tape 21 is also provided within the gap 14.

Moreover, referring again to FIG. 4, in order to ensure that the blade of the zipper (the upper side portion 221*a* of the second zipper tape 22) is inserted into the gap 14, and can protrude into a bottom end of the gap 14, so that the zipper blade is excellently fixed; a length between an upper edge of the second zipper tape 22 and an adjacent second snap 222 is greater than a length between an upper edge of the first zipper tape 21 to an adjacent first snap fastener 212. Thus, after the zipper blade is inserted into the gap 14 through the pair of snap fasteners, the upper edge of the second zipper tape 22 can be substantially flush with the upper edge of the first zipper tape 21, thereby ensuring the firmness of the insertion. When the second zipper tape 22 is needed to be pulled out from the gap 14, the second zipper tape 22 that is adhered can be easily separated from the first zipper tape 21, which makes the opening of the bag more convenient and quicker.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A child resistant bag, comprising:

a front piece;

a rear piece; wherein a first side of the front piece, a second side of the front piece and a low side of the front piece are respective adhered with a first side of the rear piece, a second side of the rear piece and a low side of the second piece; wherein an up side of the first piece and an up side of the rear piece are both opened;

a first zipper tape provided on an internal face on the up side of the front piece; wherein an entire surface of a single face of the first zipper tape is integrally adhered and connected with the front piece;

a second zipper tape provided on an internal face on the up side of the rear piece; wherein the second zipper tape is adhered and connected into one body with the rear piece only by a low side portion; at least one pair of snap fasteners which is in a shape of a strip is formed between a bottom end of an up side portion of the second zipper tape and an internal side of the first zipper tape;

a protective sheet, which is in a shape of a strip and provided in parallel with the first zipper tape; wherein an upper side of the protective sheet is adhered to the internal face on the up side of the front piece; a lower side of the protective sheet form a gap with the front piece; the up side portion of the second zipper bag is tightly inserted into the gap.

2. The child resistant bag, as recited in claim 1, wherein both sides of the protective sheet is adhered on the front piece.

3. The child resistant bag, as recited in claim 1, wherein the pair of snap fasteners comprise a female buckle and a male buckle; wherein the male buckle comprises a neck portion extending from the first zipper tape of the second zipper tape, an umbrella-shaped head extending from a top end of the neck portion; the female buckle comprises a groove portion which has a U-shaped cross section for receiving the umbrella-shaped head; and an elastic hook formed on an edge of the groove portion and extending inwardly towards the groove portion; wherein the umbrella-shaped head is inserted into the groove portion by pressing and bending the elastic hook to be deformed inwardly.

4. The child resistant bag, as recited in claim 3, wherein an amount of the pairs of the snap fasteners is two; wherein a first male snap fastener in a first pair of the snap fasteners are formed on the first zipper tape; and a second male snap fastener of the pairs of the snap fasteners is formed on the second zipper tape.

5. The child resistant bag, as recited in claim 3, wherein a first male buckle and a second male buckle of the two pairs of the snap fasteners are both provided on the first zipper tape or both on the second zipper tape.

6. The child resistant bag, as recited in claim 1, wherein the first zipper tape is integrally connected into one body with the front piece by heat pressing; and the second zipper tape is integrally connected into one body with the rear piece by heat pressing.

7. The child resistant bag, as recited in claim 1, wherein the protective sheet is adhered to the front piece by gluing.

8. The child resistant bag, as recited in claim 1, wherein the front piece and the rear piece are made of a composite or non-composite plastic material comprising: PET plastic, OPP plastic, VMPET plastic, aluminum foil material, PE plastic and CPP plastic, wherein the first zipper tape and the second zipper tape are made of PE plastic or PP plastic.

9. The child resistant bag, as recited in claim 6, wherein the front piece and the rear piece are made of a composite or non-composite plastic material comprising: PET plastic, OPP plastic, VMPET plastic, aluminum foil material, PE plastic and CPP plastic, wherein the first zipper tape and the second zipper tape are made of PE plastic or PP plastic.

10. The child resistant bag, as recited in claim 1, wherein the protective sheet is made of PE plastic, PP plastic, PVC plastic or PET plastic.

11. The child resistant bag, as recited in claim 7, wherein the protective sheet is made of PE plastic, PP plastic, PVC plastic or PET plastic.

12. The child resistant bag, as recited in claim 1, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

13. The child resistant bag, as recited in claim 2, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

14. The child resistant bag, as recited in claim 3, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

15. The child resistant bag, as recited in claim 4, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

16. The child resistant bag, as recited in claim 5, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

17. The child resistant bag, as recited in claim 6, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

18. The child resistant bag, as recited in claim 7, wherein an up edge of the first zipper tape and an up edge of the second zipper tape extend into a bottom close to the gap; wherein a length between the up edge of the second zipper tape and the pair of the snap fasteners provided thereon is greater than a length between the up edge of the first zipper tape and the pair of the snap fasteners provided thereon.

* * * * *